United States Patent [19]

Biornstad

[11] 4,080,997

[45] Mar. 28, 1978

[54] FLOW STRAIGHTENER FOR A LIQUID FLOW

[75] Inventor: Peter Biornstad, Zurich, Switzerland

[73] Assignee: Sulzer Brothers Limited, Winterthur, Switzerland

[21] Appl. No.: 721,489

[22] Filed: Sep. 8, 1976

[30] Foreign Application Priority Data

Sep. 16, 1975 Switzerland ..... 12004/75

[51] Int. Cl.[2] ..... D21F 1/06; F15D 1/04

[52] U.S. Cl. ..... 138/37; 138/39; 162/343; 162/380

[58] Field of Search ..... 162/343, 380, 216; 138/39, 37; 239/590

[56] References Cited

U.S. PATENT DOCUMENTS

| | | | |
|---|---|---|---|
| 1,552,629 | 9/1925 | Mason | 162/343 |
| 1,909,150 | 5/1933 | Bell-Irving et al. | 162/343 X |
| 3,802,966 | 4/1974 | Delekto et al. | 162/343 |
| 3,820,570 | 6/1974 | Holzhuter | 138/39 |

*Primary Examiner*—Richard V. Fisher

*Attorney, Agent, or Firm*—Kenyon & Kenyon, Reilly, Carr & Chapin

[57] ABSTRACT

The flow straightener is used in piping for papermaking machines and employs ribs which are angled at the front edge to a plane perpendicular to the flow path to avoid fiber accumulations thereon. The ribs can be disposed in tube bends or elbows and can be used in circular or rectangular pipes.

6 Claims, 7 Drawing Figures

FLOW STRAIGHTENER FOR A LIQUID FLOW

This invention relates to a flow straightener for a liquid flow and particularly for a flow of a liquid substance in a papermaking machine.

As is known, when there is a fairly fast flow through a pipe and particularly a pipe elbow, a whirling motion arises in the flow in the form of eddies which are superimposed on the translational motion. Consequently, in processes which require a very uniform flow, it is conventional to provide flow straighteners in the piping, particularly near bends and elbows. In many instances, the flow straighteners are in the form of guide vanes which extend parallel to the flow direction. Generally, these guide vanes extend across the cross-section of the pipe and are secured at opposite edges to the pipe walls.

In circular cross-section tubes, the flow straighteners are often arranged in a cross.

The known flow straighteners of this kind are, however, unsuitable for guiding the flow of liquid substances in a papermaking machine since they form deceleration points or deceleration lines on which fibers accumulate, passibly with the formation of larger fiber bunches. These bunches subsequently become carried along by the flow and dissolve with difficulty. As a result the bunches cause quality-reducing flaws to occur in the finished paper.

Accordingly, it is an object of the invention to provide a flow straightener which is suitable for use with liquids containing suspended particles.

It is another object of the invention to provide a flow straightener for a pipe of a papermaking machine through which flows a liquid containing suspended fibers.

It is another object of the invention to avoid fiber accumulations on flow straighteners in a papermaking machine pipe.

It is another object of the invention to eliminate quality-reducing flaws in finished paper due to fiber accumulations.

Briefly, the invention provides a flow straightener for a liquid flow comprised of a tube having an internal wall defining a flow path for the liquid flow and at least one rib secured to the wall within the tube. The rib extends parallel to the flow path and has a front edge relative to the liquid flow on which the liquid is incident and which defines an acute angle with a plane perpendicular to the flow path. In addition, the rib has a longitudinal edge remote from the edge secured to the wall which is disposed in spaced relation to the remainder of the wall to define a gap.

The rib construction is such as to preclude fibers from sticking thereon.

The rib also effectively obviates whirling or eddying in the flow.

The trailing edge of the rib as considered in the flow direction can also form an acute angle with a plane perpendicular to the flow direction of the liquid. This feature assists the formation of a low-eddy flow of the liquid after the trailing edge. Preferably, the angle of both inclined edges can be between 15° and 60°. Also, both the leading edge and the trailing edge can be rounded, another feature helping to produce an eddy-free flow.

At least two ribs can be disposed in a tube in a plane parallel to the tube axis, the gap being disposed between those edges of the ribs which are near one another. An arrangement particularly suitable for tubes of circular cross-section is one in which at least four ribs are disposed in a cross with a gap disposed between the inside edges of the ribs.

These and other objects and advantages of the invention will become more apparent from the following detailed description and appended claims taken in conjunction with the accompanying drawings in which:

Figure 1:
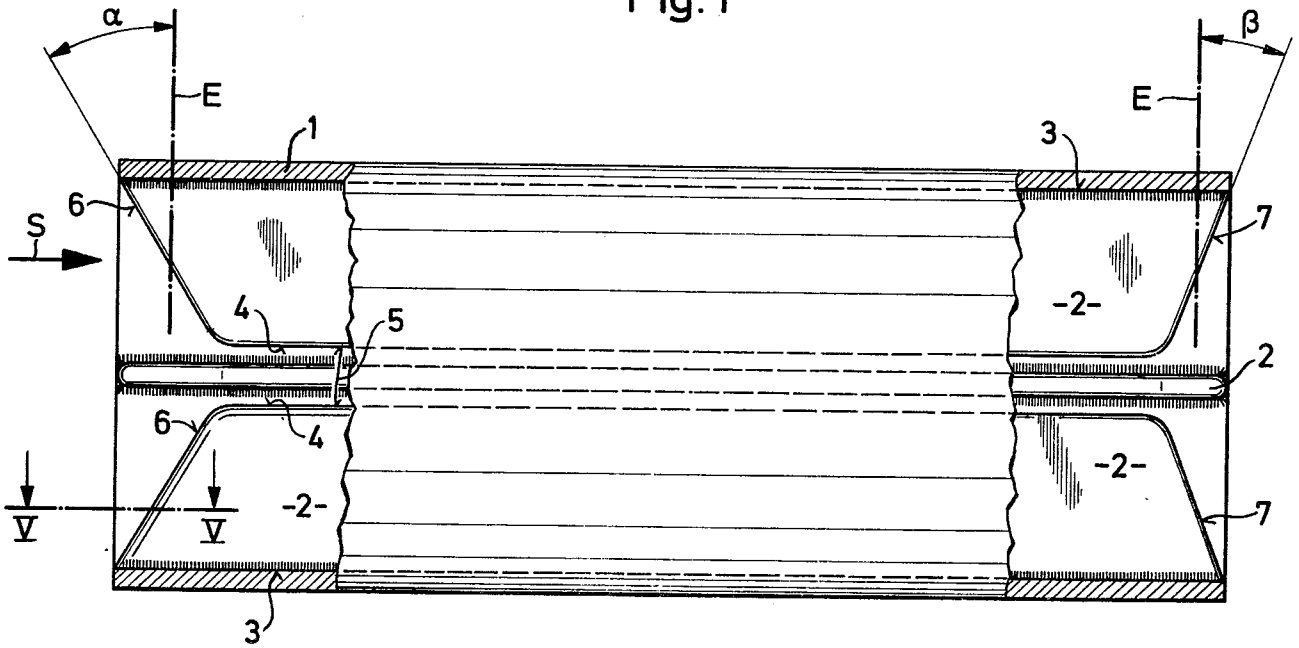
FIG. 1 illustrates a partially sectioned view of a flow straightener according to the invention.
Figure 2:
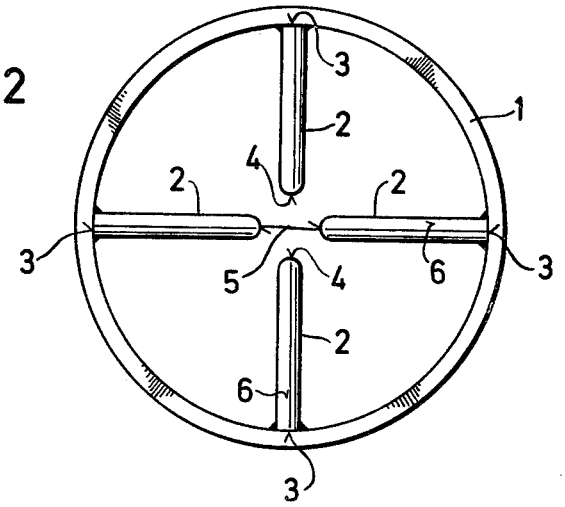
FIG. 2 illustrates a side elevational view of the flow straightener of FIG. 1.

Referring to FIG. 1, a flow straightener for smoothing a liquid flow in a pipe of a papermaking machine (not shown) is formed of a tube 1 and a plurality of internal ribs 2. As shown in FIG. 2, the tube 1 is of circular cross-section and the ribs 2 are arranged radially in a cross pattern. Each rib 2 is secured at one edge 3 to the tube wall with the opposite rib edge extending into the interior of the tube 1. A gap 5 is formed between each opposed pair of ribs 2 in any one radial plane.

As can be gathered from FIG. 1, the leading edge 6 of each rib 2, i.e. the edge on which the liquid is incident, forms an acute angle $\alpha$ with a plane E perpendicular to the flow direction S. Similarly, the trailing edge 7, i.e. the edge which is at the rear as considered in the flow direction S, forms an acute angle $\beta$ with a corresponding plane E.

The arrangement of the ribs 2 inhibits the formation of whirling flows in the tube 1 while the inclination of the leading edges 6 ensures that fibers do not accumulate thereon. The gaps 5 between the ribs 2 eliminate the rib intersection point where accumulations are very likely to form, although elimination of the crossing point does not affect the action of the straightener.

Figure 4:
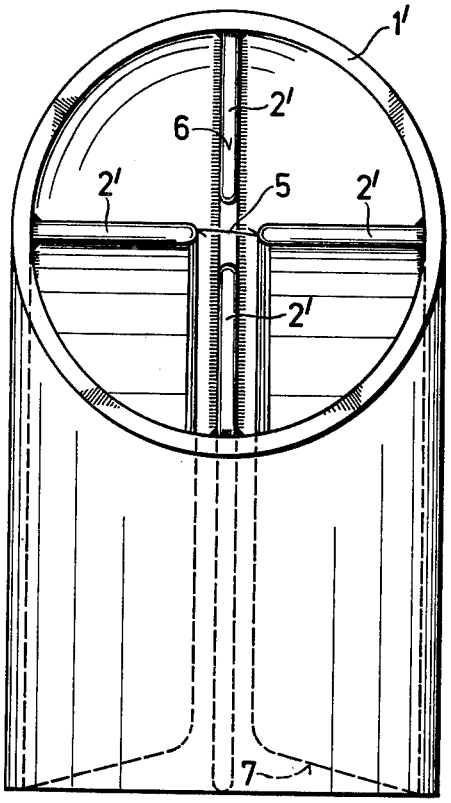
FIG. 4 illustrates a side view of the flow straightener of FIG. 3.
Figure 3:
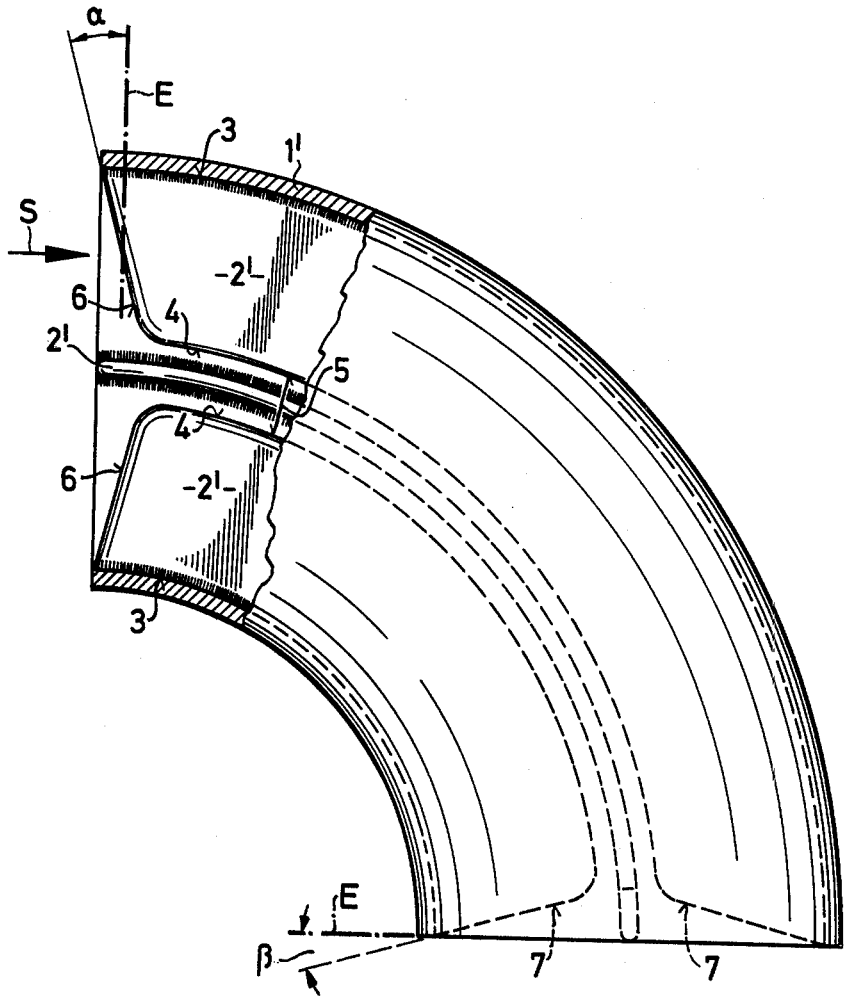
FIG. 3 illustrates a partially sectioned view of a flow straightener in the form of an elbow in accordance with the invention.

Referring to FIGS. 3 and 4, wherein like reference characters indicate like parts as above, the flow straightener may be bent in the form of an elbow. In this case, the ribs 2' are disposed in a tube elbow 1'.

Figure 5:
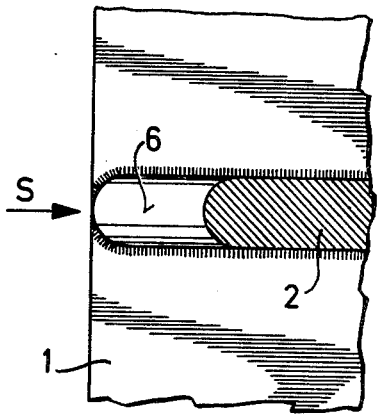
FIG. 5 illustrates a view taken on line V—V of FIG. 1.

Referring to FIG. 5, the leading edge 6 of each rib 2 (or 2') is rounded. This helps to produce a non-eddying flow along the ribs 2. The trailing edges 7 can be similarly rounded. However, the leading and trailing edges 6, 7 may in some circumstances have a sharp edge (not shown) so that the ribs have a streamline shape.

Figure 6:
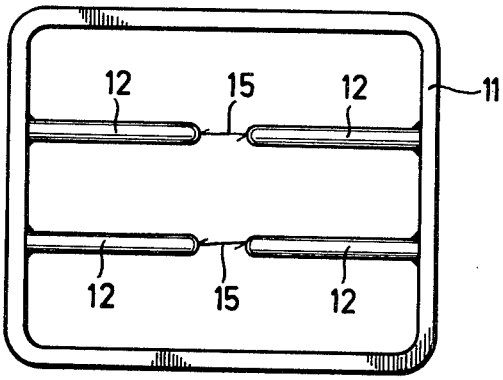
FIG. 6 illustrates a view similar to FIG. 2 of another embodiment of a flow straightener for a rectangular tube in accordance with the invention.

Referring to FIG. 6, the flow straightener may also be formed with a tube 11 of rectangular cross-section. In this case, ribs 12 are disposed on opposite walls of the tube 11 and each extends to the central region of the tube, gaps 15 being left between the opposed edges.

Figure 7:
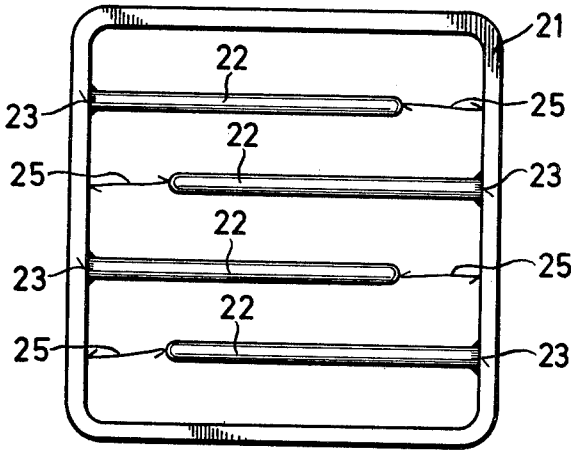
FIG. 7 illustrates a view similar to FIG. 2 of another embodiment according to the invention.

Referring to FIG. 7, the ribs 22 of a flow straightener may also be disposed in alternate relationship in a tube 21 so that gaps 25 are present near whichever tube wall region is remote from the rib edge 23 secured to the tube.

What is claimed is:

1. A flow straightener for a liquid flow comprising a tube having an internal wall defining a flow path for the liquid flow, and at least one rib secured to said wall within said tube, said rib extending parallel to said flow path and having a front edge relative to the liquid flow defining an acute angle with a plane perpendicular to said flow path, a trailing edge relative to the liquid flow defining an acute angle with a plane perpendicular to said flow path, and said rib having a longitudinal edge remote from an edge secured to said wall and disposed in spaced relation to the remainder of said wall to define a gap.

2. A flow straightener as set forth in claim 1 wherein each of said acute angles of said front edge and said trailing edge of said rib forms an angle of from 15° to 60°.

3. A flow straightener as set forth in claim 1 wherein said front edge is rounded.

4. A flow straightener as set forth in claim 1 which comprises two of said ribs disposed in opposed spaced relation to define a gap therebetween.

5. A flow straightener for a liquid flow comprising a circular tube having an internal wall defining a flow path for the liquid flow, and four ribs disposed in a cross pattern with a central gap therebetween, each said rib being secured to said wall within said tube in parallel to said flow path, each said rib having a front edge relative to the liquid flow defining an acute angle with a plane perpendicular to said flow path and a longitudinal edge remote from an edge secured to said wall and disposed in spaced relation to the remainder of said wall to define said gap.

6. A flow straightener as set forth in claim 5 wherein each said rib has a trailing edge relative to the liquid flow defining an acute angle with a plane perpendicular to said flow path.

* * * * *

UNITED STATES PATENT AND TRADEMARK OFFICE

CERTIFICATE OF CORRECTION

PATENT NO. : 4,080,997

DATED : March 28, 1977

INVENTOR(S) : Peter Biornstad

It is certified that error appears in the above-identified patent and that said Letters Patent are hereby corrected as shown below:

Column 1, line 24, change "passibly" to --possibly--

Signed and Sealed this

*Fifteenth* Day of *August 1978*

[SEAL]

*Attest:*

RUTH C. MASON
*Attesting Officer*

DONALD W. BANNER
*Commissioner of Patents and Trademarks*